US005195443A

United States Patent [19]

Williams

[11] Patent Number: 5,195,443

[45] Date of Patent: Mar. 23, 1993

[54] WINDSURFING SPREADER

[76] Inventor: Kevin B. Williams, Box 3141, Sunriver, Oreg. 97787

[21] Appl. No.: 763,618

[22] Filed: Sep. 23, 1991

[51] Int. Cl.[5] ..... B63B 35/82

[52] U.S. Cl. ..... 114/39.2; 29/DIG. 2; 29/DIG. 37

[58] Field of Search ..... 114/39.1, 39.2; 182/3; 29/6.1, 17.1, 402.19, 402.21, 34 R, 33 L, DIG. 2, DIG. 37

[56] References Cited

U.S. PATENT DOCUMENTS 4,588,044 5/1986 Mader ..... 114/39.2
4,630,563 12/1986 Pertramer ..... 114/39.2
4,712,498 12/1987 Oser ..... 114/39.2
4,741,280 5/1988 Mauderer et al. ..... 114/39.2
4,934,297 6/1990 Long ..... 114/39.2
5,069,153 12/1991 Pascher ..... 114/39.2

*Primary Examiner*—Jesus D. Sotelo
*Assistant Examiner*—Stephen P. Avila
*Attorney, Agent, or Firm*—Robert M. Sperry

[57] ABSTRACT

An improved windsurfing spreader having at least one pulley mounted thereon to rotatably engage the harness line and mounted in a manner to facilitate disengagement of the harness line from the pulley, when desired, and which is very light in weight and which is strong enough and rigid enough to withstand the stresses of windsurfing, yet which is sufficiently flexible to provide a shock-absorbing function to prevent injury to the surfer.

18 Claims, 1 Drawing Sheet

WINDSURFING SPREADER

BACKGROUND

1. Field of Invention

This invention relates to windsurfing apparatus and is particularly directed to an improved spreader for use in windsurfing.

2. Prior Art

The sport of windsurfing involves a board which is similar to a surfboard but has a mast pivotally secured thereto with a sail carried by the mast and having a so-called ¢wishbone" boom pivotally secured to the mast and extending rearwardly along both sides of the sail to join aft of the luff edge of the sail. Originally, the user would stand on the board and raise the sail by lifting the mast to a generally upright position. As wind filled the sail, the user would use his weight to hold the sail upright against the action of the wind and would control the direction of movement of the board by pulling on the forward or rearward portions of the boom. However, the effort required to accomplish this was substantial and placed considerable strain on the user's back and arm muscles. To reduce this strain, the prior art has proposed providing a generally U-shaped harness line secured to the boom, together with a relatively rigid bar strapped to the user and having a hook for slideably engaging the harness line. These devices, called "spreaders", greatly reduce the effort required to engage in windsurfing and have contributed significantly to the rapidly growing popularity of the sport. Unfortunately, sheeting of the harness line, during movement of the boom to provide directional control of the sail and board, causes the harness line to drag across the hook which causes considerable chaffing and wear of the harness line. This required frequent replacement of the harness line which is expensive and, if breakage should occur while sailing, could cause the user to undergo a fall in a possible dangerous location. Furthermore, the effort required to sheet the harness line is increased significantly by the friction across the hook which rapidly produces fatigue in the user. To avoid this problem, some spreader bars have been provided having rollers replacing the hooks to allow the harness line to move more freely. This permits faster sheeting and greatly decreases the effort required to perform the sheeting operation. Also, with the spreader bar hooks of the prior art, high winds may make it extremely difficult to disengage the harness line from the hook and may prevent the user from releasing the sail, when desired, which may have hazardous consequences. This problem, also, is greatly reduced by the use of rollers.

Although spreader bars greatly reduce the strain which the windsurfer must bear physically, this strain must be absorbed by the spreader bar itself. Consequently, the spreader bar must be formed of material which is very light in weight and which is strong enough to withstand these strains and must be sufficiently rigid to maintain its shape despite the stresses that are applied to the spreader bar. On the other hand, the spreader bar must also be sufficiently flexible to provide a shock absorbing function, since the sudden application of such heavy stress loads directly to the surfer's anatomy could cause serious and possible permanent injury. None of the prior art spreader bars have provided this combination of strength, rigidity and flexibility.

A search in the United States Patent Office has revealed the following:

| U.S. Pat. No. | INVENTOR | ISSUED |
|---|---|---|
| 4,112,865 | P. Carn | Sep. 12, 1978 |
| 4,630,563 | S. Pertramer | Dec. 23, 1986 |
| 4,712,498 | R. B. Oser | Dec. 15, 1987 |
| 4,741,280 | W. Mauderer et al | May 3, 1988 |
| 4,763,591 | D. Taylor | Aug. 14, 1988 |
| 4,934,297 | I. Long | Jun. 19, 1990 |

Each of these references discloses a windsurfing spreader bar having a hook or roller for retaining the harness line of a windsurfing board. However, none of these references suggest a spreader bar formed of a material which is very light in weight and which is strong enough and rigid enough to withstand the stresses of windsurfing, yet which is sufficiently flexible to provide a shock-absorbing function to prevent injury to the surfer. Thus, none of the prior art windsurfing spreaders have been entirely satisfactory.

BRIEF SUMMARY AND OBJECTS OF INVENTION

These disadvantages of prior art windsurfing spreaders are overcome with the present invention and an improved windsurfing spreader is provided which substantially eliminates friction of the harness line during sheeting and greatly reduces the effort required for movement of the boom and, hence, for directional control of the sail and board and which can be released quickly and easily when desired and which is formed of material which is very light in weight and which is strong enough and rigid enough to withstand the stresses of windsurfing, yet which is sufficiently flexible to provide a shock-absorbing function to prevent injury to the surfer.

The advantages of the present invention are preferably attained by providing an improved windsurfing spreader having at least one pulley mounted thereon to rotatably engage the harness line and mounted in a manner to facilitate disengagement of the harness line from the pulley, when desired, and by stamping a blank of the spreader bar from a 0.190 gauge sheet of 6061-0 alloy, coining the blank to round the edges, deburring the blank, bending the blank to provide the 90° flange and the desired radius of the spreader bar and, finally heat treating the spreader bar to a T62 temper.

Accordingly, it is an object of the present invention to provide an improved windsurfing spreader bar.

Another object of the present invention is to provide an improved windsurfing spreader bar which greatly reduces chaffing and wear of the harness line.

An additional object of the present invention is to provide an improved windsurfing spreader bar which greatly reduces the effort required of the user in sheeting the harness line.

A further object of the present invention is to provide an improved windsurfing spreader bar which can be disengaged from the harness line quickly and easily when desired.

Another object of the present invention is to provide an improved windsurfing spreader bar which permits safer and less strenuous participation in the sport of windsurfing.

An additional object of the present invention is to provide an improved windsurfing spreader bar which is very light in weight and which is strong enough and rigid enough to withstand the stresses of windsurfing, yet which is sufficiently flexible to provide a shock-absorbing function to prevent injury to the surfer.

A specific object of the present invention is to provide an improved windsurfing spreader having at least one pulley mounted thereon to rotatably engage the harness line and mounted in a manner to facilitate disengagement of the harness line from the pulley, when desired, and which is very light in weight and which is strong enough and rigid enough to withstand the stresses of windsurfing, yet which is sufficiently flexible to provide a shock-absorbing function to prevent injury to the surfer.

These and other objects and features of the present invention will be apparent from the following detailed description, taken with reference to the accompanying drawing.

BRIEF DESCRIPTION OF THE DRAWING

FIG. 4 is a view, similar to that of FIG. 2, showing an alternative form of the windsurfing spreader bar of FIG. 1;

FIG. 5 is a flow diagram showing the steps required to form the windsurfing spreader bar of FIG. 1;

FIG. 6 is a vertical section through a "wave" roller for use with the spreader bar of the present invention; and FIG. 7 is a vertical section through a "slalom" roller for use with the spreader bar of the present invention.

DETAILED DESCRIPTION OF THE INVENTION

Figure 1:
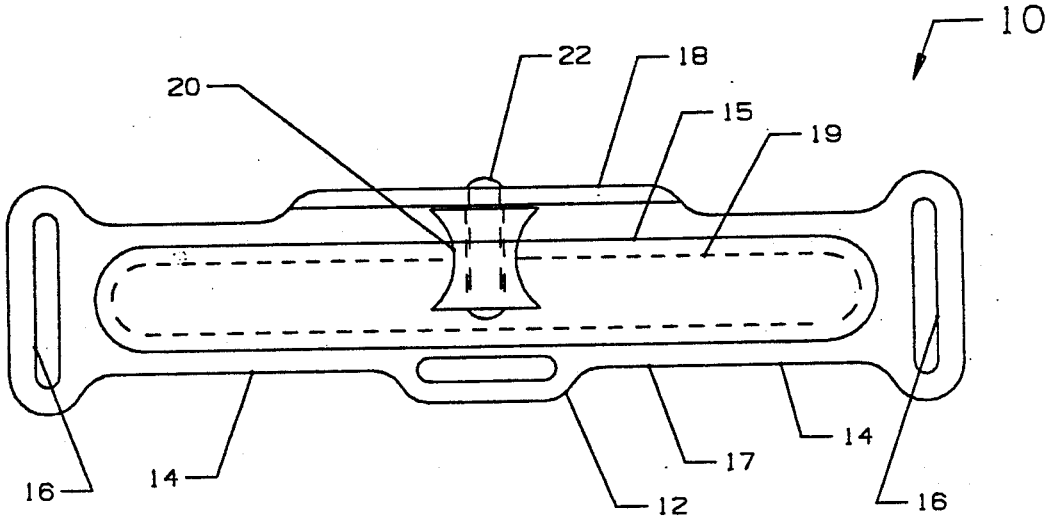
FIG. 1 is a front view of a windsurfing spreader bar embodying the present invention.
Figure 2:
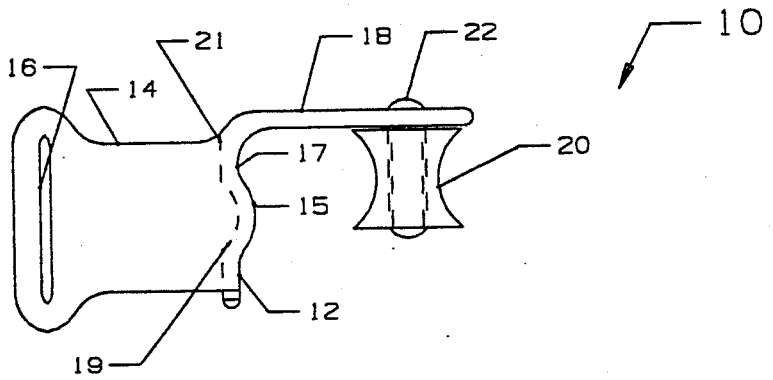
FIG. 2 is a side view of the windsurfing spreader bar of FIG. 1.
Figure 3:
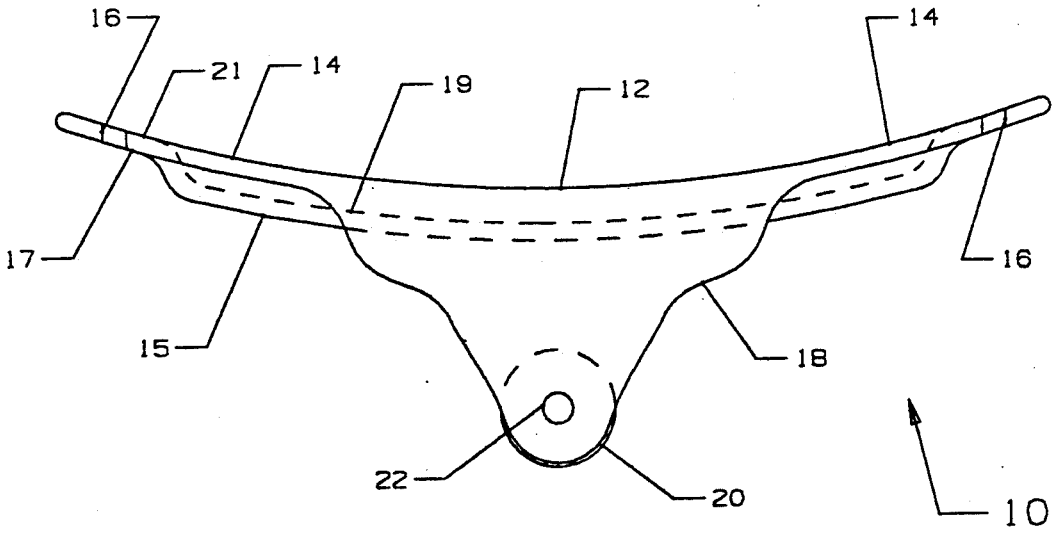
FIG. 3 is a top view of the windsurfing spreader bar of FIG. 1.

In that form of the present invention chosen for purposes of illustration in the drawing, FIGS. 1, 2 and 3 show a windsurfing spreader, indicated generally at 10, comprising a spreader bar 12 formed with side portions 14 which curve rearwardly, forming a radius of approximately 16 inches, as best seen in FIG. 3, and which are formed with openings 16 to receive a belt or the like for securing the spreader 10 across the front of a user's body. The spreader bar 12 is preferably formed of a single, integral piece of material which is very light in weight and which is strong enough and rigid enough to withstand the stresses of windsurfing, yet which is sufficiently flexible to provide a shock-absorbing function to prevent injury to the surfer. It has been found that a 0.190 gauge thickness of 6061 alloy, available from Pacific Metal Co., when formed in the manner described below and illustrated in FIG. 5, will provide the desired characteristics. The spreader bar 12 has a flange 18 projecting forwardly from one edge of the spreader bar 12 at an angle of approximately 90°, as best seen in FIG. 2, and may have a roller 20 rotatably mounted perpendicular to the flange 18, as by pivot 22, which also serves to secure the roller 20 to the flange 18. Different forms of the roller 20 may be provided, as seen in FIGS. 6 and 7 and described below. Alternatively, as seen in FIG. 4, a hook 24 may be substituted for the roller 20, if desired, depending from the outer end of the flange 18. If desired, a rib 15 may be provided extending laterally across the front surface 17 of the spreader bar 12, as seen in FIGS. 1, 2 and 3, to assist in distributing the forces exerted on the spreader bar 12. The rib 15 may be formed by simply adding additional material to the front surface 17 of the spreader bar 12 or, preferably, for forming a recess 19 in the rear surface 21 of the spreader bar 12, which forms the rib 15 without adding additional weight to the spreader bar 12.

Some sailboard sailors prefer the hook 24 because it is integral with the spreader bar and, hence, provides a stronger and more positive attachment. Others prefer the roller 20 because it facilitates faster and easier movement of the harness, as in sheeting. As seen in FIGS. 6 and 7, different forms of the roller 20 are available. FIG. 6 shows a "wave" roller, indicated generally at 26, having an upper flange 28 which is approximately 1.25 inches in diameter and a body portion 30 which curves concavely inward and downward to a waist diameter of approximately 0.750 inch, as seen at 32, and, thereafter, flares convexly outward and downward to a lower diameter of approximately 0.95 inch, as seen at 34. A central bore 36 extends vertically through the roller 20 to receive the pivot 22, as described above with respect to FIG. 1. The concavely curved upper portion 32 of the "wave" roller 26 facilitates sheeting of the harness. At the same time, for wave jumping and the like, the ability to instantaneously disconnect the spreader bar from the harness is extremely important and may be a matter of life and death. The convexly curved lower portion 34 of the body 30 of the "wave" roller 26 accommodates such rapid disconnection. FIG. 7 shows a "slalom" roller, indicated generally at 38, having an upper flange 40 which is approximately 1.25 inches in diameter and a body portion 42 which curves concavely inward and downward to a waist diameter of approximately 0.750 inches, as seen at 44, and continues to curve concavely downward and outward to a lower flange 46 having a diameter of approximately 1.375 inches. The "slalom" roller 38 provides great speed and ease of sheeting, while the lower flange 46 provides protection against inadvertent disconnection of the harness from the spreader bar.

As illustrated in FIG. 5, the windsurfing spreader bar 12 is formed from a single, integral piece of 3/16 inch thick or 0.190 gauge sheet of 6061 alloy. The 6000 series alloys, available from Pacific Metal Co., are alloys of aluminum, copper, magnesium, zinc and silicon containing sufficient proportions of silicon and magnesium to form magnesium silicide, thus making the alloys heat treatable. The blank is, initially, untempered and is cold worked by stamping out a flat blank, having the general configuration of the spreader bar 12, which is then coined to provide rounded edges. Next, the blank is deburred and is placed in a two-stage progressive forming die which bends the flange 18 to its 90° position and gives the side portions 14 the desired 16 inch radius, thus resulting in the form of the spreader bar 10 seen at 12 in FIGS. 1–3. After this, the formed spreader bar 10 is treated in a heated solution containing more of the alloying ingredients, such as copper, magnesium, zinc and silicon, since aluminum shows increasing solid solubility for these metals at increasing temperatures and this heat treatment serves to super-saturate the aluminum and produces considerable strengthening of the aluminum. This heat treatment is followed by rapid quenching in water, which "freezes" the structure. Finally, the spreader bar 10 is artificially aged by maintaining the spreader bar 10 at a slightly above room temperature for a period of time to allow precipitation of the alloying components which tempers and further enhances the strength of the spreader bar 10, yielding a Rockwell strength rating of 89° to 98°. The resulting product is found to be extremely light in weight, is strong enough and rigid enough to withstand the stresses of windsurfing, yet is sufficiently flexible to provide a significant shock-absorbing function and is highly resistant to atmospheric or chemical corrosion. Tests of the spreader bar 10, formed in this way, have shown that the spreader bar 10 will withstand loading up to 600 pounds per square inch with only 0.025 inch deformation and can resists loads up to 1,724 pounds per square inch without excessive deformation.

In use, the user laces a belt or the like through the openings 16 of the side portions 14 and secures the spreader 10 across the front of their body. Then, they mount the windsurfing board, raise the mast and sail, and loops the harness about the pulley 28. This attaches the user to the windsurfing board and allows the user's weight, rather than their back and arm muscles, to aid in holding the mast upright against the action of the wind. When the user desires to change direction, they adjust the angle of the sail and boom, which causes the harness to be sheeted through the spreader 10 about the pulley 28. Because the pulley 28 is rotatably mounted, sheeting of the harness is subjected to rolling friction, rather than sliding friction as has been the case with prior art spreaders. This greatly reduces chaffing of the harness and results in significantly increased life for the harness. Moreover, the rolling friction requires considerably less effort on the part of the user in performing the sheeting action. This materially reduces the strain on the user and permits longer and less tiring sailing. Finally, when the user desires to disengage from the windsurfing board, they simply grip the boom with both hands and pull the rig toward them. This produces slack in the harness which permits the harness to fall free of the pulley 28 to release the user. This action can be performed quickly and easily whenever desired and, thus, assures that the user can release themselves from the windsurfing board promptly and easily should a dangerous situation threaten.

Obviously, numerous variations and modifications can be made without departing from the spirit of the present invention. Therefore, it should be clearly understood that the forms of the present invention described above and shown in the accompanying drawing are illustrative only and are not intended to limit the scope of the present invention.

What is claimed is:

1. A windsurfing spreader bar comprising:

a spreader bar having side portions for securing said bar across the front of a user's body, an arm formed integral with said spreader bar projecting forwardly from one edge of said spreader bar, means located adjacent the outer end of said arms for releasably retaining a harness, and said spreader bar is initially cold stamped from a sheet of untempered material and, after forming, is heat treated in a solution containing copper, magnesium, zinc and silicon to super-saturate the aluminum, is quenched in water, and then is maintained at slightly above room temperature to permit precipitation of the super-saturants.

2. The spreader bar of claim 1 wherein:

said last named means is a roller.

3. The spreader bar of claim 2 wherein:

said roller has an upper flange and a body portion curving concavely inward and downward to a waist diameter and curving concavely downward and outward from said waist.

4. The spreader bar of claim 3 wherein:

the diameter of said upper flange is approximately 1.25 inches, the diameter of said waist is approximately 0.75 inch and the diameter of the lower end of said roller is approximately 0.95 inch.

5. The spreader bar of claim 2 wherein:

said roller has an upper flange and a body portion curving concavely inward and downward to a waist diameter and continuing to curve concavely downward and outward to a lower flange.

6. The spreader bar of claim 5 wherein:

the diameter of said upper flange is approximately 1.25 inches, the diameter of said waist is approximately 0.75 inch and the diameter of said lower flange is approximately 1.375 inches.

7. The spreader bar of claim 1 wherein:

said last named means is a generally U-shaped member mounted adjacent the outer end of said arm and extending forwardly, downwardly and rearwardly from said arm.

8. The device of claim 1 wherein:

said spreader bar is formed of an alloy containing aluminum, copper, magnesium, silicon and zinc.

9. The device of claim 8 wherein:

said alloy is 6061.

10. The device of claim 1 wherein:

said spreader bar has a thickness of 3/16 inch.

11. The windsurfing bar of claim 1 further comprising:

a rib extending laterally across said spreader bar to assist in distributing the forces on said spreader bar.

12. The windsurfing bar of claim 11 wherein:

said rib is formed by additional material added to said spreader bar.

13. The windsurfing bar of claim 11 wherein:

said rib is created by forming a recess in the opposite surface of said spreader bar.

14. The windsurfing bar of claim 1 wherein:

said spreader bar has a Rockwell strength rating of 89°–98°.

15. The method of producing a windsurfing spreader bar comprising the steps of:

cold stamping a blank having the general configuration of said spreader bar from a 0.190 gauge sheet of an alloy containing aluminum, cooper, magnesium, silicon and zinc, shaping said blank to form a windsurfing spreader bar, heat treating said spreader bar in a solution containing copper, magnesium, silicon and zinc to supersaturate said spreader bar, quenching said spreader bar in water, and maintaining said spreader bar slightly above room temperature to allow precipitation of the supersaturants.

16. The method of claim 15 wherein:

said forming step comprising coining said blank to round the edges thereof, and shaping said blank in a two-stage progressive forming die to bend said arm to project forward from said blank at an angle of approximately 90° and bending said side portions to a radius of approximately 16 inches.

17. The method of claim 16 wherein:

said shaping step comprising coining said blank to round the edges thereof, and shaping said blank in a two-stage progressive forming die to bend an arm to project forward from said blank at an angle of approximately 90° and bending side portions of said blank to a radius of approximately 16 inches.

18. The method of claim 15 wherein:

said method causes said spreader bar to have a Rockwell strength rating of 89°–98°.

* * * * *